United States Patent [19]

Cowie et al.

[11] Patent Number: 5,060,125

[45] Date of Patent: Oct. 22, 1991

[54] LAMP ASSEMBLY

[75] Inventors: John C. Cowie; Kenneth J. Soper, both of Worcester, United Kingdom

[73] Assignee: CMB Foodcan plc, Worcester, United Kingdom

[21] Appl. No.: 673,138

[22] Filed: Mar. 20, 1991

[30] Foreign Application Priority Data

Mar. 22, 1990 [GB] United Kingdom ..... 9006409

[51] Int. Cl.[5] ..... F21S 3/00

[52] U.S. Cl. ..... 362/218; 362/219; 362/217

[58] Field of Search ..... 362/218, 219, 225, 217

[56] References Cited

U.S. PATENT DOCUMENTS

| | | | |
|---|---|---|---|
| 2,298,824 | 10/1942 | Darley | 362/219 |
| 3,788,560 | 1/1974 | Hough et al. . | |
| 4,229,785 | 10/1980 | Tuller . | |
| 4,240,130 | 12/1980 | Stilling | 362/217 |
| 4,250,390 | 2/1981 | Nicholson . | |

*Primary Examiner*—Carroll B. Dority

*Attorney, Agent, or Firm*—Christie, Parker & Hale

[57] ABSTRACT

A lamp assembly comprises a lamp housing having a removable top cover and a removable end cover. A pair of cradle arrangements are contained in the lamp housing. One of the cradle arrangements comprises two individual lamp cradles, while the other cradle arrangement comprises three individual cradles. The cradle arrangements may be removed from the lamp housing by removing the top cover or, alternatively, by removing the end cover. Each of the individual cradles has an ultra violet lamp mounted thereon. When the cradle arrangements are positioned in the lamp housing, the individual cradles are disposed successively along a common axis but in a staggered fashion with respect to the common axis. The cradles are arranged so that the individual lamps are substantially parallel to the common axis and so that the ends of neighbouring cradles overlap each other. It is thus possible to achieve a relatively long light source using relatively short lamps. An end of each lamp is releasably held by a holder mounted on the associated cradle.

10 Claims, 6 Drawing Sheets

LAMP ASSEMBLY

BACKGROUND OF THE INVENTION

This invention relates to a lamp assembly and, particularly but not exclusively, to an assembly of ultra violet lamps for curing ink on printed web material and which can be incorporated in a printing press.

In a conventional printing press, ink (or other coating material) which has been deposited on a substrate is dried by the application of heat. Relatively recently, some printing presses have been using coating material which is cured by ultra violet light and this offers the attraction that curing can be effected in a fraction of a second, so leading to increased productivity and saving in space.

An ultra violet lamp of relatively short length is capable of producing a high radiant flux density and such a lamp can be restarted rapidly. As the length of the lamp is increased, there is a reduction in the radiant flux density that can be produced and an increase in the restart time. There is presently a requirement for an ultra violet light source which is capable of curing ink printed on relatively wide web material. The use of a relatively long ultra violet lamp as the ultra violet light source is not satisfactory as such a lamp would produce a relatively low radiant flux density and have a relatively long restart time. There is also a requirement to be able to remove and replace lamps easily and quickly.

BRIEF SUMMARY OF THE INVENTION

According to one aspect of this invention, there is provided a lamp assembly comprising a cradle housing, at least two cradle arrangements contained in said cradle housing, each cradle arrangement comprising at least two cradles secured together, and an individual elongate lamp mounted in each cradle. The individual cradles are disposed successively along a common axis but in a staggered fashion with respect to said common axis. The cradles are arranged so that the individual lamps are substantially parallel to the common axis. The cradles are arranged so that the ends of neighbouring cradles overlap each other.

According to a second aspect of this invention, there is provided a lamp assembly comprising a cradle housing having a removable end cover and at least one further removable cover, at least two cradles contained in said cradle housing, and an individual elongate lamp mounted in each cradle. The individual cradles are disposed successively along a common axis but in a staggered fashion with respect to said common axis. The cradles are arranged so that the individual lamps are substantially parallel to the common axis. The cradles are arranged so that the ends of neighbouring cradles overlap each other.

According to a third aspect of this invention, there is provided a lamp assembly comprising a cradle housing, at least two cradles contained in said cradle housing, and an individual elongate lamp mounted in each cradle. The individual cradles are disposed successively along a common axis but in a staggered fashion with respect to said common axis. The cradles are arranged so that the individual lamps are substantially parallel to the common axis. The cradles are arranged so that the ends of neighbouring cradles overlap each other. Each cradle has a lamp holder at each end thereof and, in each cradle, at least one lamp holder comprises a first plate secured to the cradle, a first insulator carried by the plate, a second plate, means for releasably securing the second plate to the cradle, and a second insulator carried by the second plate, said first and second plates together with said first and second insulators being arranged to cooperate with each other to hold the end of a lamp mounted on the holder.

With the lamp assembly of this invention, a relatively long light source can be obtained using lamps each of which is relatively short.

It is to be understood that, for convenience, in the description now to be given with reference to the drawings there is described a lamp assembly which is operating so that the light which it emits is directed downwardly. A lamp assembly located above web material moving in a horizontal direction would have such an orientation. However, the lamp assembly of this invention is to be understood as being capable of operating in other orientations.

DETAILED DESCRIPTION

Figure 5:
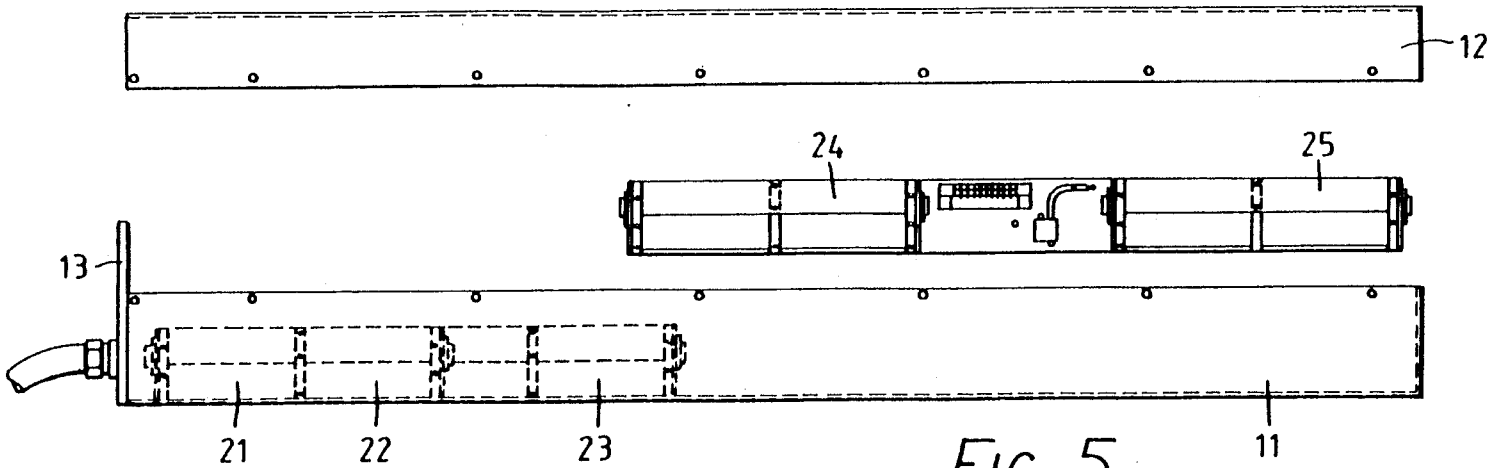
FIG. 5 is a side view of the lamp assembly of FIG. 1 showing a method of removing the lamp cradles through the top of the lamp housing.
Figure 6:
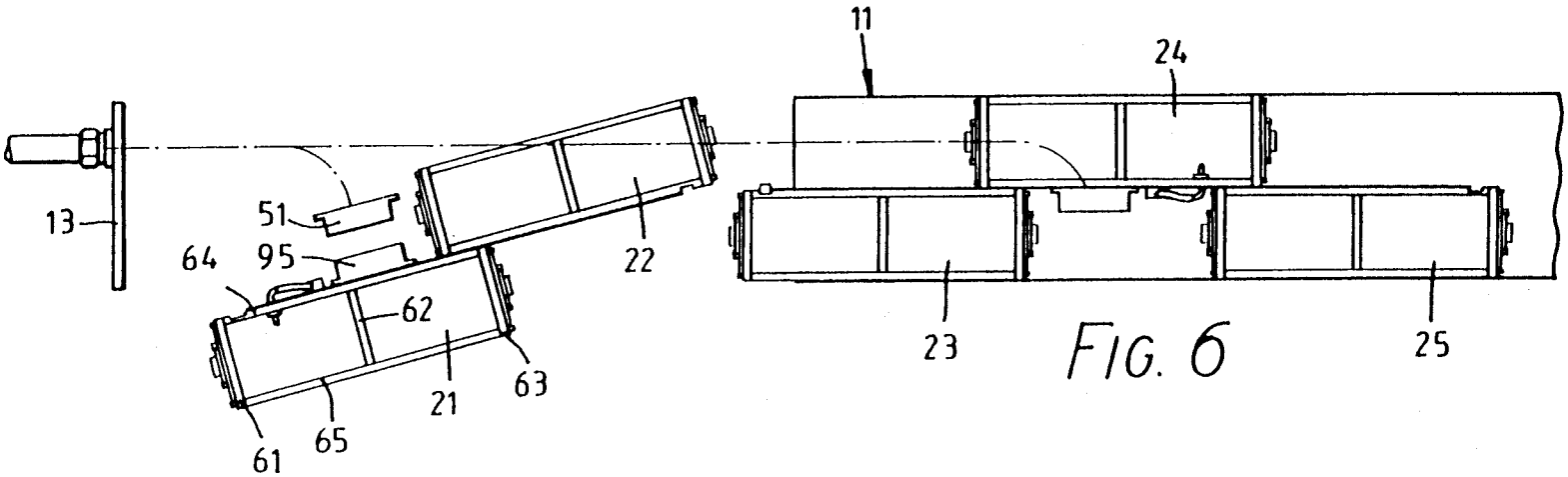
FIG. 6 is a top view of part of the lamp assembly of FIG. 1 showing a method of removing the lamp cradles through the end of the lamp housing.
Figure 7:
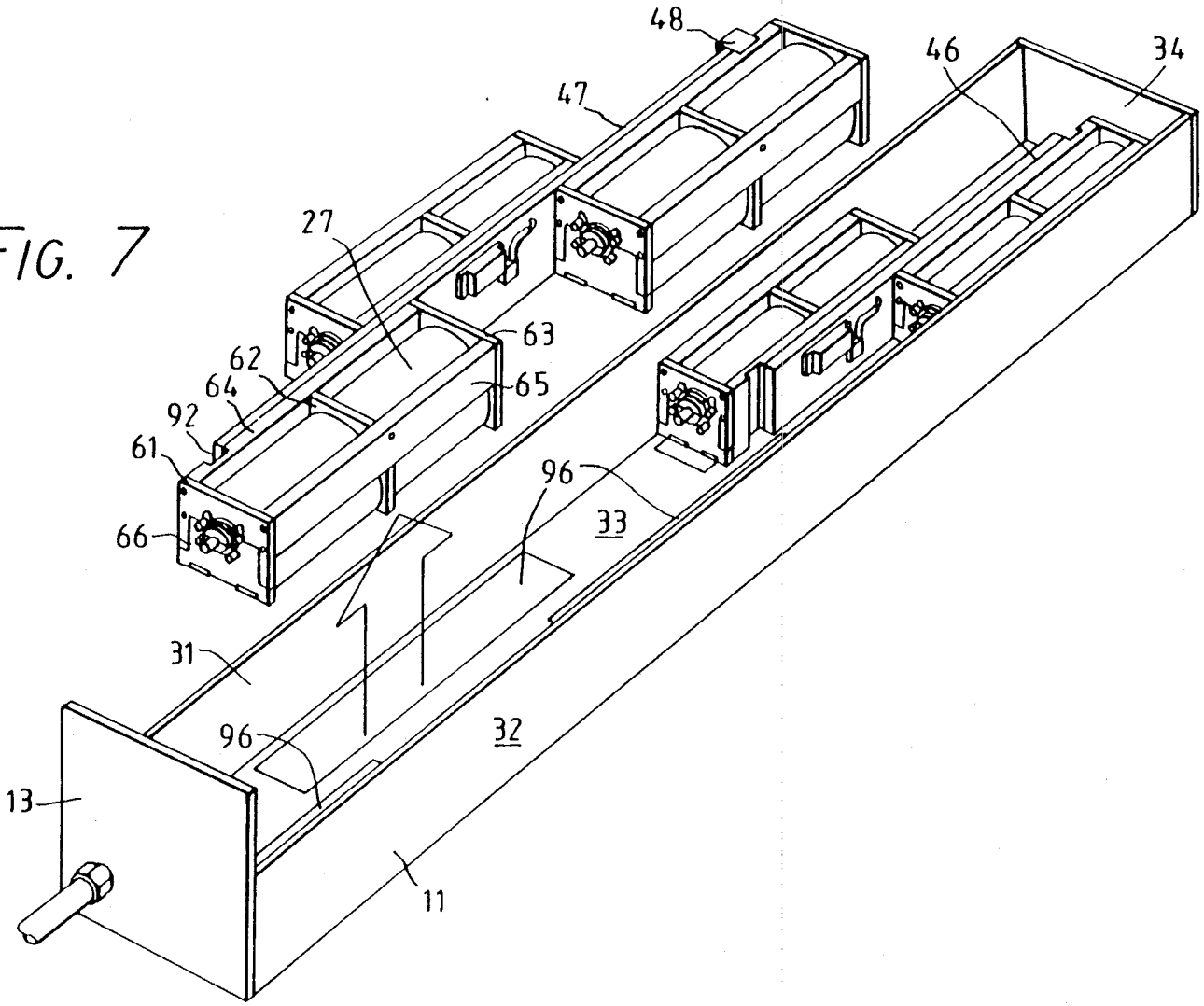
FIG. 7 is a perspective view of part of another lamp assembly embodying this invention showing the method of removing the cradles through the top of the lamp housing.
Figure 8:
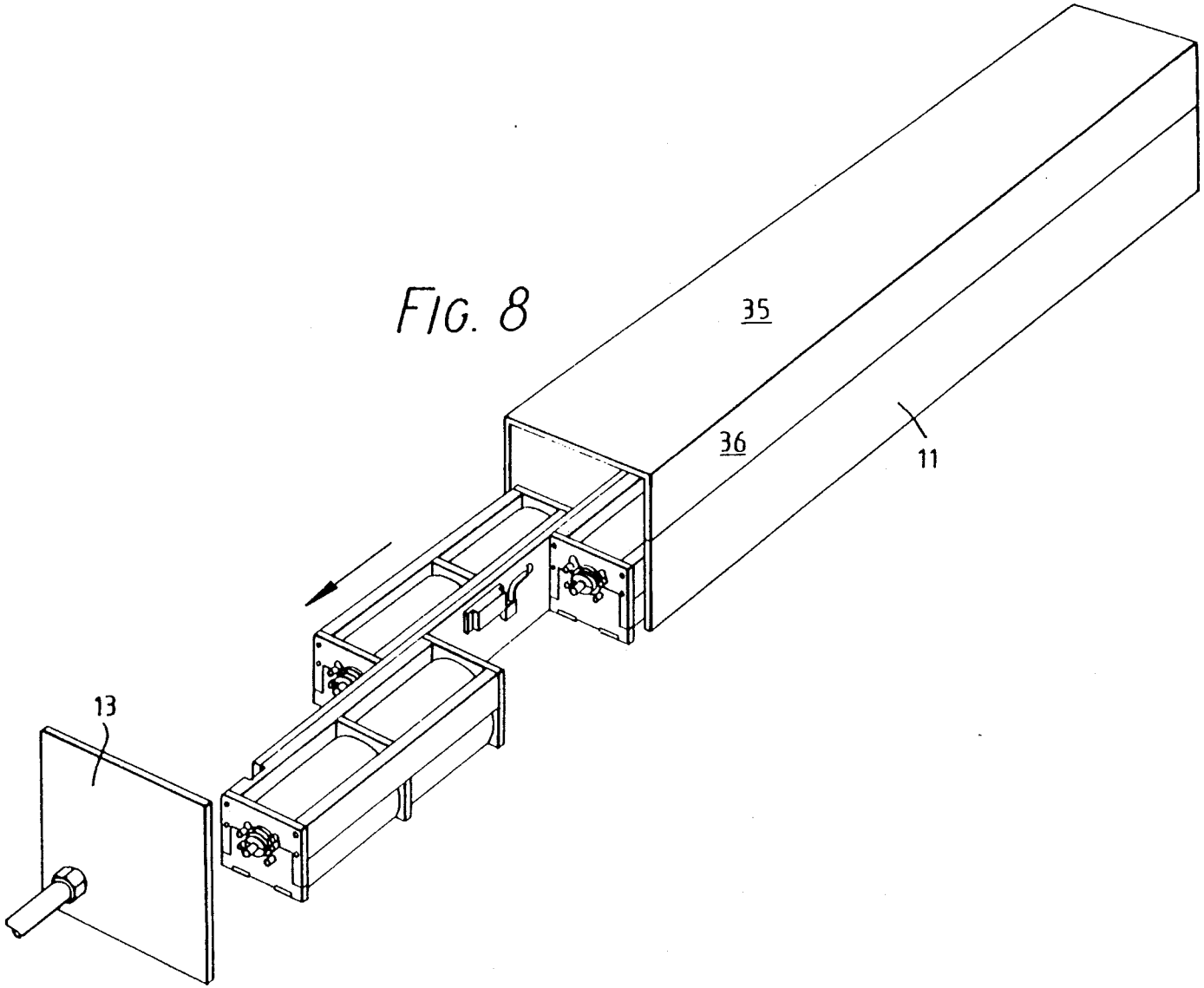
FIG. 8 is a perspective of part of the lamp assembly of FIG. 7 showing the method of removing the lamp cradles through the end of the lamp housing.

The lamp assembly of FIGS. 1 to 6 and 9 to 11 is generally similar to the lamp assembly of FIGS. 7 and 8 with one small difference. As viewed in the drawings, the lamp assembly of FIGS. 1 to 6 has a double cradle arrangement on its left side and a triple cradle arrangement on its right side. In the lamp assembly of FIGS. 7 and 8, the triple cradle arrangement is on the left and the double cradle arrangement is on the right. The two cradle assemblies will be described together and the same reference numerals will be used for like parts.

Referring now to FIGS. 1 to 4, there is shown a lamp assembly 10 comprising a lamp housing 11, a top cover 12 for the lamp housing 11, an end cover 13 for the lamp housing 11 and three blower units 14. There is also shown a flexible conduit 15 containing power and control leads and which terminates at a bulkhead fitting 16 mounted on the lamp housing 11.

Figure 2:
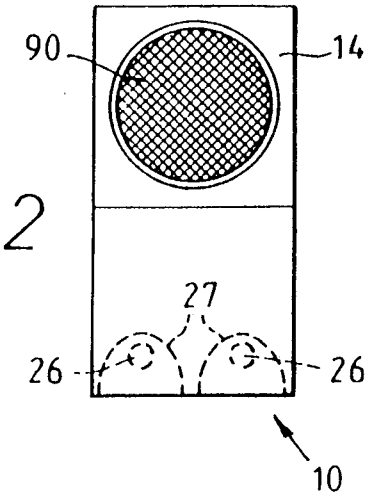
FIG. 2 is an end view of the lamp assembly of FIG. 1.
Figure 4:
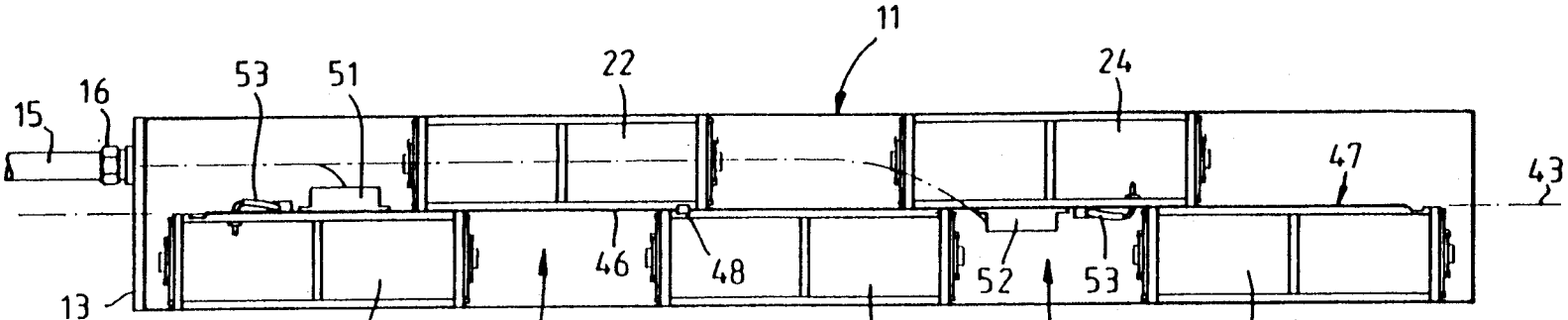
FIG. 4 is a top view of the lamp assembly of FIG. 1 with the blower units and the top cover removed.

As shown in FIG. 4, the lamp housing 11 contains five lamp cradles 21 to 25. Each of the lamp cradles 21 to 25 has an elongate mercury arc ultra violet lamp mounted thereon, two of which are shown in FIG. 2 by dashed lines and indicated by reference numeral 26. Each of the lamp cradles also has an elongate reflector 27 of elliptical cross section which is positioned to direct the light from the respective ultra violet lamp downwardly.

As best shown in FIG. 7, the lamp housing 11 has a pair of side walls 31 and 32, a bottom wall 33 and an end wall 34. The bottom wall 33 supports the cradles 21 to 25 from beneath, and has rectangular apertures 96 corresponding in positions to the cradles and through which UV radiation and cooling air from the cradles can pass in a downward direction. As best shown in FIG. 8, the top cover 12 has a top wall 35, a pair of side walls one of which is indicated by reference numeral 36, and an end wall (not shown).

Figure 1:
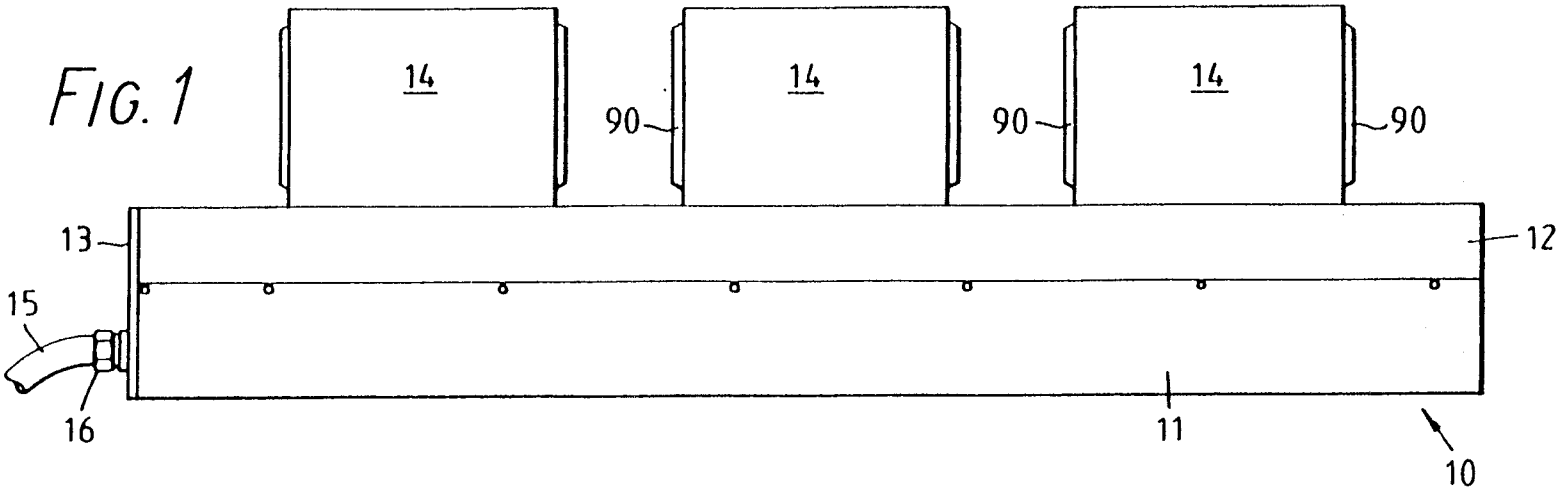
FIG. 1 is a side view of a lamp assembly embodying this invention.
Figure 3:
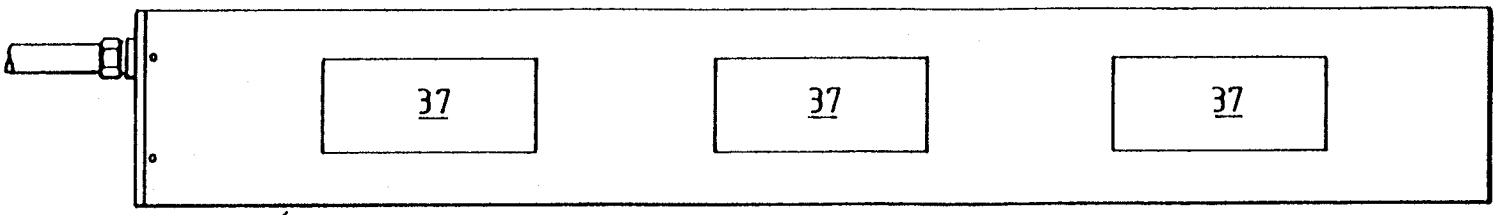
FIG. 3 is a top view of the lamp assembly of FIG. 1 with the blower units removed.
Figure 10:
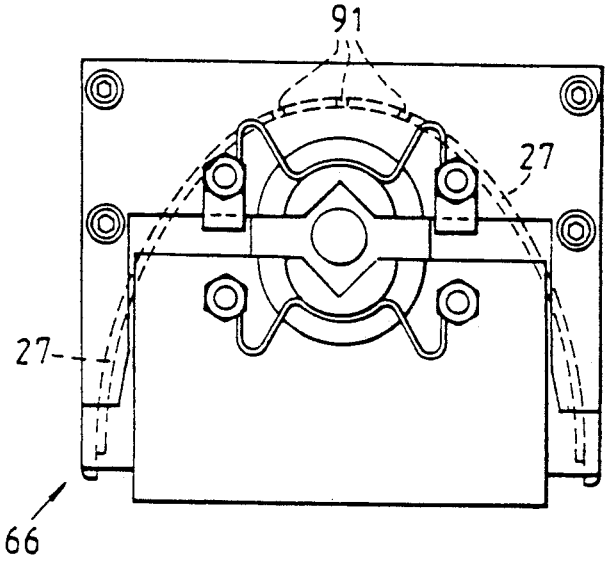
FIG. 10 is another end view of a lamp cradle of FIG. 9 showing the lamp holder in a state in which one of the holder plates has been partly removed.

As may be seen in FIGS. 1 and 2, the three blower units 14 are mounted on top of the top cover 12. Each of the blower units 14 has two inlets, and each inlet has a filter 90. As shown in FIG. 3, the top wall 35 of the top cover 12 has three apertures 37, each of which is located beneath one of the blower units 14. Cooling air from the blower units 14 passes through the apertures 37 and then passes around the lamps 26 and over the reflectors 27 before escaping through the apertures 96 in the bottom wall 33 of the lamp housing 11. To allow the escape of cooling air which passes down the outside surfaces of the reflectors 27, the bottom three edges of the reflectors are spaced by a small clearance above the bases of the respective cradles, as can be seen in FIG. 10 which shows one reflector in dashed line.

Although not apparent from the drawings, the lamps 26 are cooled directly by cooling air supplied from the blower units 14. For that purpose the reflectors 27 are formed with an array of small holes (91, FIG. 10), and the ends of the apertures 96 are located beyond the ends of the reflectors. The sides of the apertures 96 lie substantially directly beneath the bottom edges of the reflectors.

As may be seen in FIG. 4, the cradles 21 to 25 are disposed successively along a common axis 43 but in a staggered fashion with respect to this axis. Thus, cradles 21, 23 and 25 lie on one side of axis 43 while cradles 22 and 24 lie on the other side. The cradles are also arranged so that the lamps 26 are parallel to axis 43. As may also be seen in FIG. 4, the ends of neighbouring cradles overlap each other.

The cradles 21 to 25 are divided into two cradle arrangements 44 and 45. In the cradle arrangement 44, the cradles 21 and 22 are secured in common to a vertical plate 46 which extends between keyways 92 formed in adjacent sides of the cradles at their remote ends. In the cradle arrangement 45, cradles 23, 24 and 25 are likewise secured to a common vertical plate 47 which extends between keyways 92 in the remote ends of the cradles 23, 25. With the cradles 21 to 25 disposed inside the lamp housing 11, the plates 46 and 47 lie on the common axis 43, and the keyways 92 of the cradles 22, 23 are in register. One of those keyways has a square key 48 secured in it, and this key is releasably located in the other keyway to form a latching mechanism which connects the cradle arrangements 44 and 45 together in a detachable manner.

In order to supply power to the cradle arrangements 44, 45, as indicated by chain dotted line, the power and control leads from the bulkhead fitting 16 extend to plugs 51 and 52. The plugs 51 and 52 are received in sockets 95 (FIG. 6) mounted on the common plates 46, 47. Leads from the sockets are connected to the terminals of the lamps 26. The cradles 21 and 24 are also provided with air pressure transducers 53 which are connected into circuit via the adjacent sockets 95. The pressure sensors 53 detect the positive air pressure caused by the presence of the cooling air and, in use, supply a control signal to an associated unit (not shown). The control unit is arranged to energise the lamps 26 only when the positive air pressure is detected.

When the lamp assembly 10 is installed in a printing press, it is necessary to remove the cradles 21 to 25 from time to time either to replace a failed lamp or for general servicing. While the cradles are being removed and replaced, the entire printing press is put out of action and it is clearly desirable to be able to perform this operation as quickly as possible. Access to the lamp assembly varies from printing press to printing press and, consequently, a method of removing the cradles which is possible in one printing press may not be possible in another one. As will now be described, with the lamp assembly 10, the cradles can be removed and replaced quickly and there are two alternative methods for carrying out this operation.

Referring now to FIGS. 6 and 8, in one method of removing and replacing the cradles, the end cover 13 is removed from the lamp housing. The cradle arrangement 44 is then pulled out endwise. The cradle arrangement 44 pulls the cradle arrangement 45 out behind it and thus both cradle arrangements may be removed quickly if desired. After the cradle arrangements have been removed, they can be separated quickly from each other. Alternatively, and as shown in FIG. 6, the cradle arrangement 44 can be detached by a pivoting movement, leaving the arrangement 45 still partly located within the housing.

If desired, a cradle arrangement may be easily disconnected from the power and control leads and replaced by a further cradle arrangement. The two cradle arrangements can then be located in the lamp housing 11 simply by reversing the procedure just described.

Referring now to FIGS. 5 and 7, in the second method of removing the cradle arrangements, the blower units 14 together with top cover 12 are removed from the lamp housing 11. The cradle arrangements can then be lifted out upwardly.

Apart from the keyways 92 of the cradles 21, 22, 23 and 25, and the key 48, the cradles 21 to 25 are identical. The cradle 25 Will now be described in detail with reference to FIGS. 6 and 7.

The cradle 25 comprises three identical formers 61, 62, 63 which are held together by a pair of side rails 64 and 65. The keyways 92 of the cradles 21 to 25 are formed in the appropriate one of these side rails. Each of the formers 61 to 63 has an elliptical cut out and the reflector 27 is mounted in this cut out. In order to mount the lamp 26 in position, each end of the cradle 21 is provided with a lamp holder, one of these lamp holders being indicated in FIG. 7 by reference numeral 66. The lamp holder 66 will now be described with reference to FIGS. 9 to 11.

The lamp holder 66 comprises a first or upper plate 70 which has a pair of legs 71. The lamp holder also has a spring plate 72, the lower edge of which has a pair of upturned tongues 73. The upper plate 70 and the plate spring 72 are secured to the former 61 and the side rails 64 and 65 by four bolts 74. A pair of tongue-shaped holding elements 75 project downwardly from upper plate 70 and are secured thereto by a pair of bolts 76.

A second or lower plate 78 is located between legs 71 and releasably held in position by the holding elements 75 and the upwardly turned tongues 73 of spring plate 72.

A pair of insulators 81 and 82 are releasably mounted, respectively on upper and lower plates 70 and 78 and held in place by a pair of wire springs 83, 84. The spring 83 is secured to upper plate 70 by the bolts 76 while the spring 84 is secured to lower plate 78 by a pair of bolts 85. The insulators 81 and 82 together have a generally circular cross-section but form a square-shaped central aperture. Each insulator 81, 82 has a boss portion 87 (FIG. 11) with a rounded outer surface against which the respective spring 83, 84 bears. The boss portion extends axially of cradle 21 from an integral flange portion 88 which the spring holds captive and in face-to-face abutment with the respective upper or lower plate 70, 78.

Figure 9:
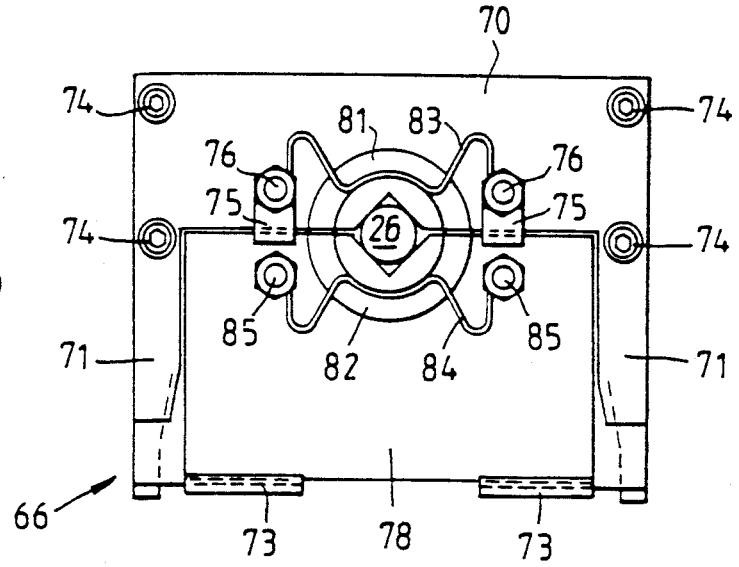
FIG. 9 is an end view of a lamp cradle forming part of the lamp assembly of FIG. 1 showing a lamp holder.
Figure 11:
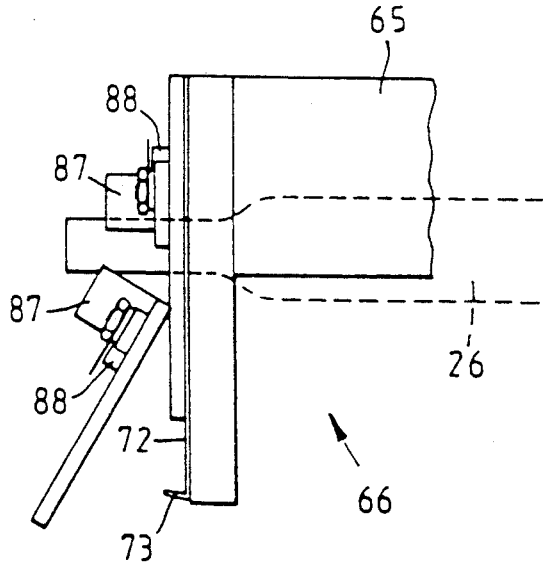
FIG. 11 is a fragmentary side view of the end of the lamp cradle of FIG. 9 showing the lamp holder in the same state as depicted in FIG. 10.

As shown in FIG. 9, the end of lamp 26 is located in the square-shaped aperture defined by insulators 81 and 82 and clamped resiliently in position by these two insulators. As illustrated in FIGS. 10 and 11, the end of lamp 26 may be released rapidly simply by unclipping the lower plate 78 from the tongues 73, and swinging it away from the spring plate 72.

The assembly described with reference to FIGS. 1 to 11 is capable of producing a relatively long light source using relatively short mercury arc lamps. Thus, the lamp assembly can be used to cure ink on a relatively wide printed web. Because the individual lamps are relatively short, it is possible to achieve a relatively high radiant flux density on the web material. Also, because the lamps are relatively short, it is possible to achieve a relatively fast start up time. The lamp assembly is suitable for curing inks or other UV-curable coating material on a wide variety of substrates. Examples of such substrates are webs of paper and plastics material, and hardboard. There are many applications for such substrates. For example, in the case of paper web, the web may be printed with consecutive rows of labels, these labels being cut from the printed web after the ink has been cured.

Each of the lamp assemblies of FIGS. 1 to 6 and 7 to 8 uses a combination of a double cradle arrangement and a treble cradle arrangement. With a lamp cure length of 10 inches (254 mm), a cure length of 50 inches (1270 mm) may be achieved. As shown in the table below, various cure lengths may be achieved with suitable combinations of the double and treble cradle arrangements.

| Cure length | Double cradle arrangement | Treble cradle arrangement |
|---|---|---|
| 90" (2286 mm) | — | 3 |
| 80" (2032 mm) | 1 | 2 |
| 70" (1778 mm) | 2 | 1 |
| 60" (1524 mm) | — | 2 |
| 50" (1270 mm) | 1 | 1 |
| 40" (1016 mm) | 2 | — |
| 30" (762 mm) | — | 1 |
| 20" (508 mm) | 1 | — |

Various modifications may be made to the lamp assembly described above without departing from the present invention. For example, in place of the blower units 14, cooling air may be supplied via ducts from a remotely situated blower unit. Also, reflector shapes other than elliptical (e.g. parabolic) may be used if desired.

Although the lamp assembly has been described with reference to ultra violet lamps, it is also suitable for use with lamps of other wavelengths where it is desired to achieve a relatively long light source with relatively short lamps.

What we claim is:

1. A lamp assembly comprising:

a cradle housing;

at least two cradle arrangements contained in said cradle housing, each cradle arrangement comprising at least two cradles secured together; and an individual elongate lamp mounted in each cradle;

the individual cradles being disposed successively along a common axis but in a staggered fashion with respect to said common axis, the cradles being arranged so that the individual lamps are substantially parallel to the common axis, and the cradles being arranged so that the ends of neighbouring cradles overlap each other.

2. A lamp assembly as claimed in claim 1, in which each cradle arrangement has a central plate extending substantially the whole length of the cradle arrangement, the individual cradles being secured to said common plate.

3. A lamp assembly as claimed in claim 1, in which each pair of neighbouring cradles is provided with a latching mechanism for releasably securing the two cradles together.

4. A lamp assembly as claimed in claim 1, in which the cradle housing has a removable end cover and at least one further removable cover.

5. A lamp assembly as claimed in claim 1, in which each cradle is provided with an elongate reflector.

6. A lamp assembly as claimed in claim 1, including means for supplying cooling air to the lamps.

7. A lamp assembly as claimed in claim 1, in which the lamps are ultra violet lamps.

8. A lamp assembly comprising:

a cradle housing having a removable end cover and at least one further removable cover;

at least two cradles contained in said cradle housing; and an individual elongate lamp mounted in each cradle;

the individual cradles being disposed successively along a common axis but in a staggered fashion with respect to said common axis, the cradles being arranged so that the individual lamps are substantially parallel to the common axis, and the cradles being arranged so that the ends of neighbouring cradles overlap each other.

9. A lamp assembly comprising;

a cradle housing;

at least two cradles contained in said housing; and an individual elongate lamp mounted in each cradle;

the individual cradles being disposed successively along a common axis but in a staggered fashion with respect to said common axis, the cradles being arranged so that the individual lamps are substantially parallel to the common axis, and the cradles being arranged so that the ends of neighbouring cradles overlap each other;

each cradle having a lamp holder at each end thereof and, in each cradle, at least one lamp holder comprising:

a first plate secured to the cradle;

a first insulator carried by the first plate;

a second plate;

means for releasably securing the second plate to the cradle; and a second insulator carried by the second plate;

said first and second plates together with said first and second insulators being arranged to cooperate with each other to hold the end of a lamp mounted on the holder.

10. A lamp assembly as claimed in claim 9, in which the releasably securing means comprises:

at least one plate holding element projecting from the first plate; and a spring member secured to the cradle, said at least one plate holding element and said spring member being arranged to cooperate together to hold said second plate in position.

* * * * *